United States Patent [19]

Tadashima

[11] Patent Number: 4,840,124

[45] Date of Patent: Jun. 20, 1989

[54] ROVE BOBBIN TRANSPORTING SYSTEM

[75] Inventor: Fumio Tadashima, Kanazawa, Japan

[73] Assignee: Murao Boki Kabushiki Kaisha, Kanazawa, Japan

[21] Appl. No.: 196,425

[22] Filed: May 20, 1988

[30] Foreign Application Priority Data

May 27, 1987 [JP] Japan ..... 62-131005

[51] Int. Cl.[4] ..... B61B 13/12

[52] U.S. Cl. ..... 104/163; 104/168; 198/465.4; 198/803.12; 198/464.3

[58] Field of Search ..... 104/163, 162, 90, 91, 104/94, 168; 105/155; 242/35.5 A; 198/465.4, 803.12, 687, 684, 464.3; 57/90, 281

[56] References Cited

U.S. PATENT DOCUMENTS

| | | | |
|---|---|---|---|
| 121,605 | 12/1871 | Fitzgerald | 104/163 X |
| 2,975,729 | 3/1961 | Stechbart et al. | 104/94 X |
| 3,828,682 | 8/1974 | Klein | 104/91 |
| 4,368,037 | 1/1983 | Limque et al. | 104/168 X |
| 4,473,997 | 10/1984 | Kawasaki et al. | 57/90 X |
| 4,586,326 | 5/1986 | Igel | 57/281 |
| 4,671,186 | 1/1987 | Kunczynski | 104/168 |
| 4,735,042 | 4/1988 | Igel | 104/91 X |

FOREIGN PATENT DOCUMENTS

| | | | |
|---|---|---|---|
| 3328487 | 2/1985 | Fed. Rep. of Germany | 104/91 |
| 563341 | 12/1977 | U.S.S.R. | 104/163 |

*Primary Examiner*—Robert B. Reeves
*Assistant Examiner*—Joseph D. Pape
*Attorney, Agent, or Firm*—Oblon, Spivak, McClelland, Maier & Neustadt

[57] ABSTRACT

The present invention relates to a system for transporting rove bobbins between a flyer frame and a spinning frame wherein transporting operation of rove bobbins can be assured for a long period of time. The system comprises a plurality of driving devices provided at fixed positions along a transport rail. A carrier for hanging rove bobbins thereon is smoothly moved along the transport rail by way of a mechanical engaging structure which establishes motion transmission between the carrier and a successive one of the driving devices.

8 Claims, 4 Drawing Sheets

10
20
24
30
34
34a
35
36
37
TC

ROVE BOBBIN TRANSPORTING SYSTEM

BACKGROUND OF THE INVENTION

1. Field of the Invention:

This invention relates to a rove bobbin transporting system in a spinning plant for interconnecting a flyer frame and a spinning frame to transport fully wound rove bobbins from the former to the latter and to transport empty rove bobbins in the opposite direction.

2. Discussion of the Background:

In a spinning plant, roves wound up on a flyer frame are fed to a spinning frame on which they are finished into predetermined yarns. Since the production capacity of a single flyer frame corresponds to a production capacity of several spinning frames, roves wound up by a single flyer frame must be separately transported as rove bobbins in several spinning frames, and to this end, a rove bobbin transporting system is employed.

As one of various types of such rove bobbin transporting systems, a rove bobbin transporting system of the type is used for general purposes wherein a carrier on which a large number of rove bobbins are removably suspended travels along a transport rail which is installed near a ceiling of a building.

In the rove bobbin transporting system, the carrier is constituted such that a guide roller is provided on the upper face side of a carrier frame in the form of an elongated plate for engaging with the transport rail while a plurality of rove bobbins are suspended on the lower face side of the carrier frame by way of bobbin hangers. Friction rollers are pressed against opposite side faces of the carrier frame, and as the friction rollers are driven to rotate, the carrier is fed by the friction rollers. A drive motor is provided at an intermediate position of the transport rail, and rotation of the motor is transmitted to drive shafts provided along the transport rail. Conical friction rollers are fitted at intermediate positions of the drive shafts and are contacted with conical friction rollers provided on shafts of the friction rollers to drive the friction rollers for the carrier frame to rotate.

In such a conventional rove bobbin transporting system as described just above, since frictional motion transmitting mechanisms are provided at two locations of the conical friction wheels and the friction rollers as driving devices for feeding the carrier, abrasion of such friction members cannot be avoided. Accordingly, it is a problem of the conventional rove bobbin transporting system that operation with a high degree of reliability cannot be assured for a long period of time.

SUMMARY OF THE INVENTION

It is an object of the present invention to provide a novel rove bobbin transporting system wherein reduction in reliability due to abrasion of parts can be eliminated by employing a motion transmitting mechanism which depends upon mechanical engagement instead of a motion transmitting mechanism which depends upon friction.

In particular, the present invention enables smooth operation of a rove bobbin transporting system for a long period of time by making it possible for a driving device of the rove bobbin transporting system to continuously feed a carrier and by eliminating the presence of a friction member between the driving device and the motion transmitting mechanism for the carrier.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Figure 1:
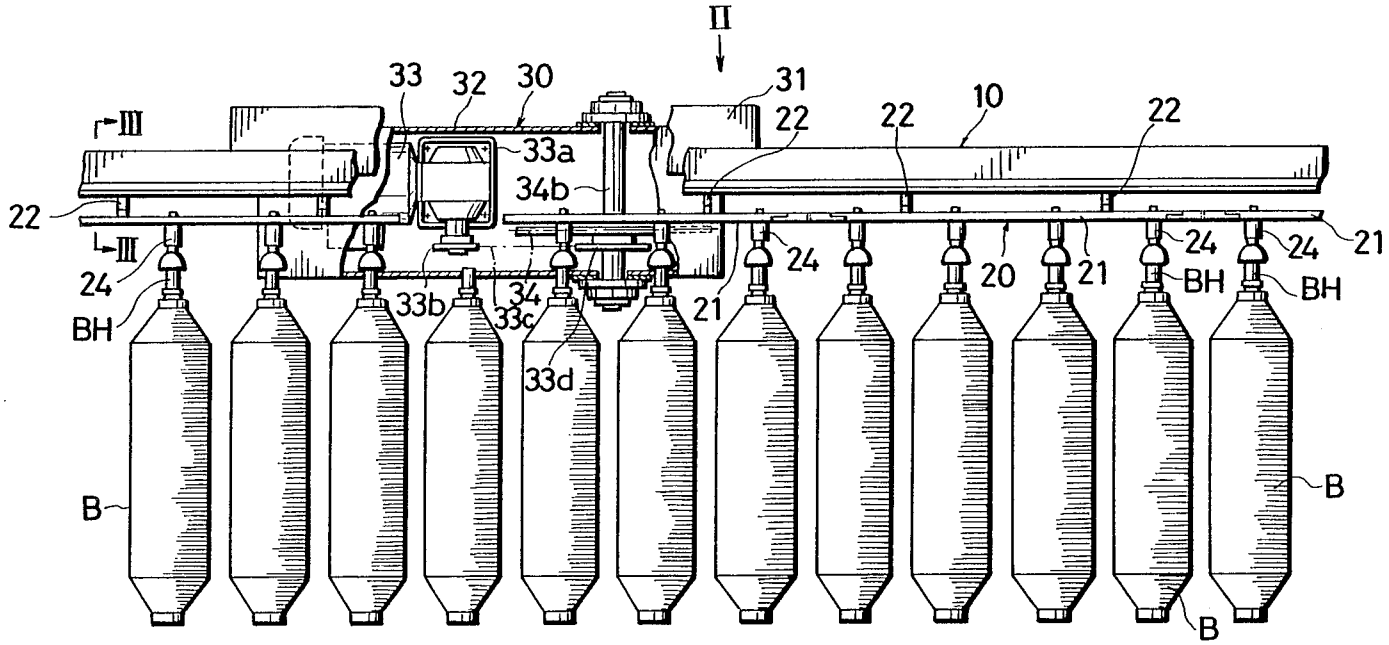
FIG. 1 is a front elevational view, partly in section, of a rove bobbin transporting system showing preferred embodiment of the present invention.
Figure 2:
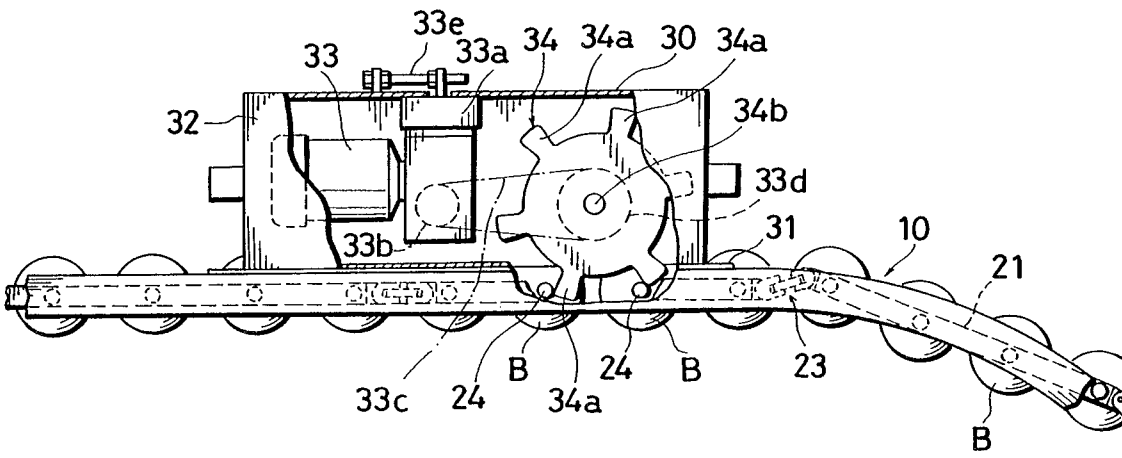
FIG. 2 is a plan view as viewed in the direction of an arrow mark II in FIG. 1.

Referring first to FIGS. 1 and 2, a rove bobbin transporting system includes, as principal components, a transport rail 10, a carrier 20 and a plurality of driving devices 30 disposed along the transport rail 10.

Figure 3:
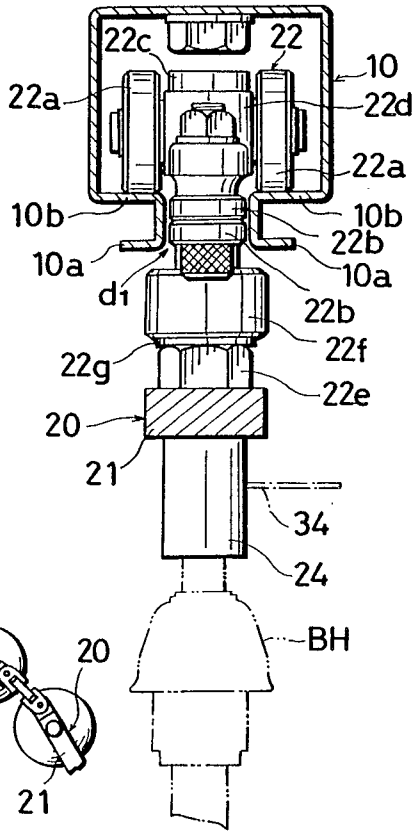
FIG. 3 is a sectional view taken along line III—III in FIG. 1.

Referring also to FIG. 3, the transport rail 10 is an elongated member which is securely installed on a ceiling or the like of a building (not shown) by means of fastening bolts 11. The transport rail 10 has a substantially angular Ω-shape in vertical cross section as seen in FIG. 3 and thus defines an opening $d_1$ at the lower end thereof. The transport rail 10 has a pair of horizontal legs 10*a* formed at the lower end thereof and a pair of horizontal support portions 10*a* formed above the horizontal legs 10*a* thereof. The transport rail 10 extends over a predetermined transport section, for example, between a flyer frame and a spinning frame.

Figure 4:
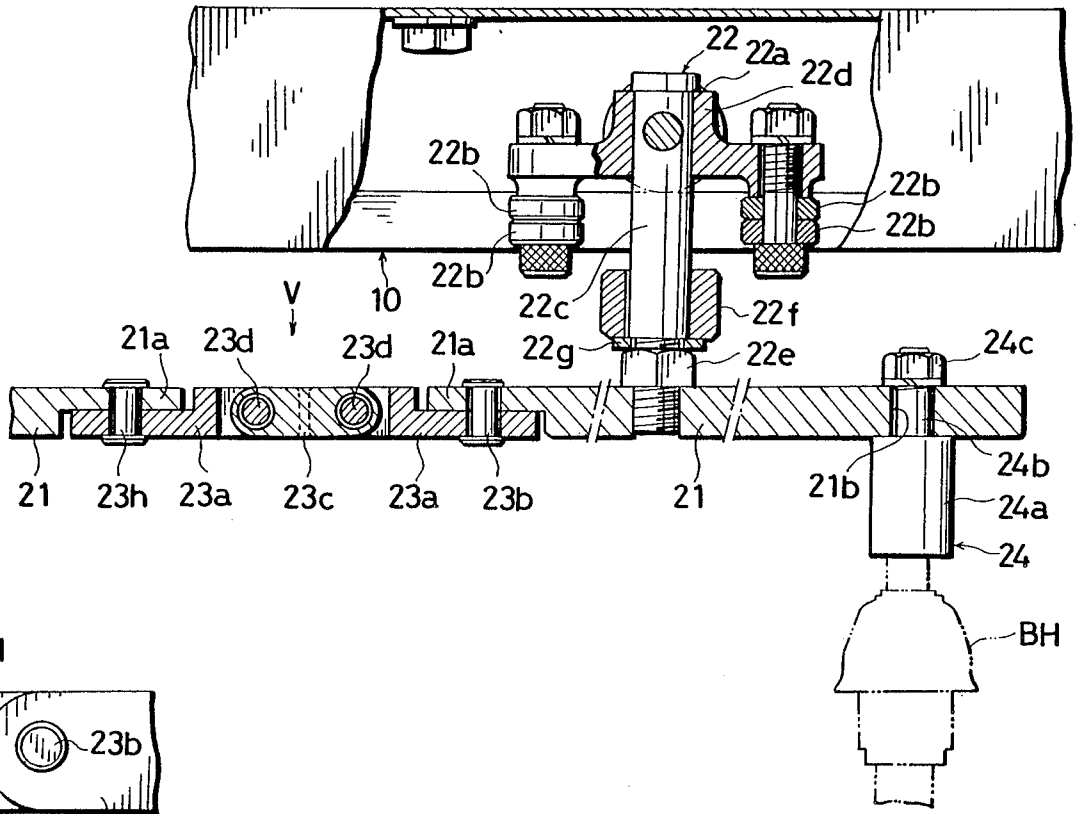
FIG. 4 is a side elevational view, partly broken, of FIG. 3.
Figure 5:
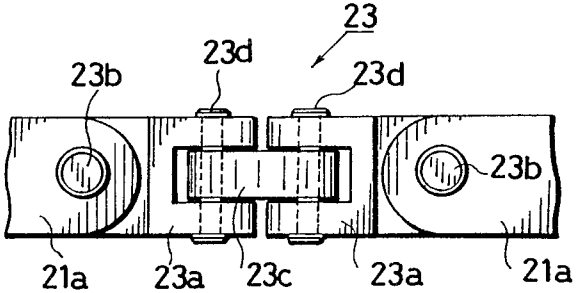
FIG. 5 is a plan view as viewed in the direction of an arrow mark V in FIG. 4.

Referring to FIG. 1, the carrier 20 includes a predetermined number of carrier frames 21 connected to each other in the longitudinal direction of the transport rail 10. Each of the carrier frames 21 has roller units 22 provided at least two front and rear locations thereof and is suspended on the transport rail 10 by way of the roller units 22. Referring also to FIGS. 4 and 5, a joint mechanism 23 is formed at a connecting portion between each two adjacent ones of the carrier frames 21. The joint mechanism 23 includes a pair of tongues 21*a* extending from the adjacent carrier frames 21 and assembled to each other for bending motion both in vertical and hroizontal directions by way of two pairs of pins 23*b* and 23*d*, a pair of intermediate members 23*a* and another intermediate member 23*c*. Here, the pins 23*b* extend in vertical directions while the pins 23*d* extend in horizontal directions. Each of the carrier frames 21 is a bar member in the form of a simple prism.

Referring to FIGS. 3 and 4, each of the roller units 22 by means of which the carrier frames 21 are suspended on the transport rail 10 includes a pair of vertical rollers 22*a* mounted for rolling movement on upper faces of the supporting portions 10*b* of the transport rail 10, and two pairs of horizontal rollers 22*b* mounted for rolling movement in the opening $d_1$ of the transport rail 10. The rollers 22*a* and 22*b* are supported for rotation on a single support bolt 22*c* by way of a bracket 22*d*. In particular, the pair of vertical rollers 22*a* are disposed on opposite left and right sides of the support bolt 22*c* while the two pairs of horizontal rollers 22*b* are disposed two by two on opposite front and rear sides of the support bolt 22*c*.

A lower end of the support bolt 22*c* is screwed in the carrier frame 21 so that the vertical position of the carrier frame 21 relative to the transport rail 10 can be adjusted by a set nut 22*e*. A bush 22*f* having an outer diameter greater than the opening $d_1$ of the transport rail 10 and a washer 22*g* are loosely fitted at a lower portion of the support bolt 22*c* above the set nut 22*e*. Accordingly, when the carrier frame 21 is pushed upwardly, the support bolt 22*c* will not collide with any fastening bolt 11 for the transport rail 10.

Referring to FIG. 1, a plurality of bobbin hangers BH are mounted at equal intervals on a lower face of each of the carrier frames 21. Each of the bobbin hangers BH is constituted such that a rove bobbin B may be removably hung thereon. The bobbin hangers BH may be of the known type, and if a rove bobbin B is forced up from below a bobbin hanger BH with their axes aligned with each other, it is held by a hook mechanism provided in the bobbin hanger BH and is thus hung on the bobbin hanger BH. To the contrary, if the rove bobbin B held in this manner is forced up again, then the hook mechanism is released automatically and consequently the rove bobbin B can be released from the bobbin hanger BH.

Referring to FIGS. 3 and 4, each of the bobbin hangers BH is mounted on one of the carrier frames 21 by way of a mounting bracket 24 which will be hereinafter referred to only as bracket 24 for short. The bracket 24 includes a cylindrical body portion 24*a* and a mounting threaded portion 24*b* provided at the top of the body portion 24*a*. The threaded portion 24*b* of the bracket 24 extends upwardly through a fastening hole 21*b* perforated in the carrier frame 21, and a nut 24*c* is screwed to the upward extension of the threaded portion 24*b* of the bracket 24 to secure the bracket 24 to the carrier frame 21. It is to be noted that connection between the bobbin hanger BH and the bracket 24 is established by screwing of a threaded portion provided projectingly at the top of the bobbin hanger BH into a threaded hole not shown provided in a bottom wall of the bracket 24. The brackets 24 are mounted at equal intervals on the carrier frames 21 such that the interval may be maintained constant also at the connecting portions between the carrier frames 21.

Referring to FIGS. 1 and 2, each of the driving devices 30 is mounted on a side face of the transport rail 10 by way of a mounting bracket 31. The driving device 30 includes a drive motor 33 and a rotary sprocket wheel 34 as principal parts and is accommodated in a small accommodating box 32.

The drive motor 33 is a geared motor installed on a slide base 33*a*, and an output power shaft of the drive motor 33 is connected to the rotary sprocket wheel 34 by way of a chain sprocket wheel 33*b*, a chain 33*c* and another chain sprocket wheel 33d. The rotary sprocket wheel 34 and the chain sprocket wheel 33*d* may both be fitted on a rotary shaft 34*b* supported for pivotal motion and extending in a vertical direction in the accommodating box 32 as seen in FIG. 2. The slide base 33*a* is disposed for movement in forward and backward directions by way of adjusting screw 33*e* in order to allow adjustment of the tension of the chain 33*c*.

The rotary sprocket wheel 34 may partially extend below the transport rail 10 as seen in FIG. 1 and rotates in a horizontal plane. The rotary sprocket wheel 34 has teeth 34*a* the shape and pitch of which are selected so as to allow the teeth 34*a* to engage with the bracket 24 securely mounted on the lower faces of the carrier frames 21.

Figures 6A, 6B, 6C:
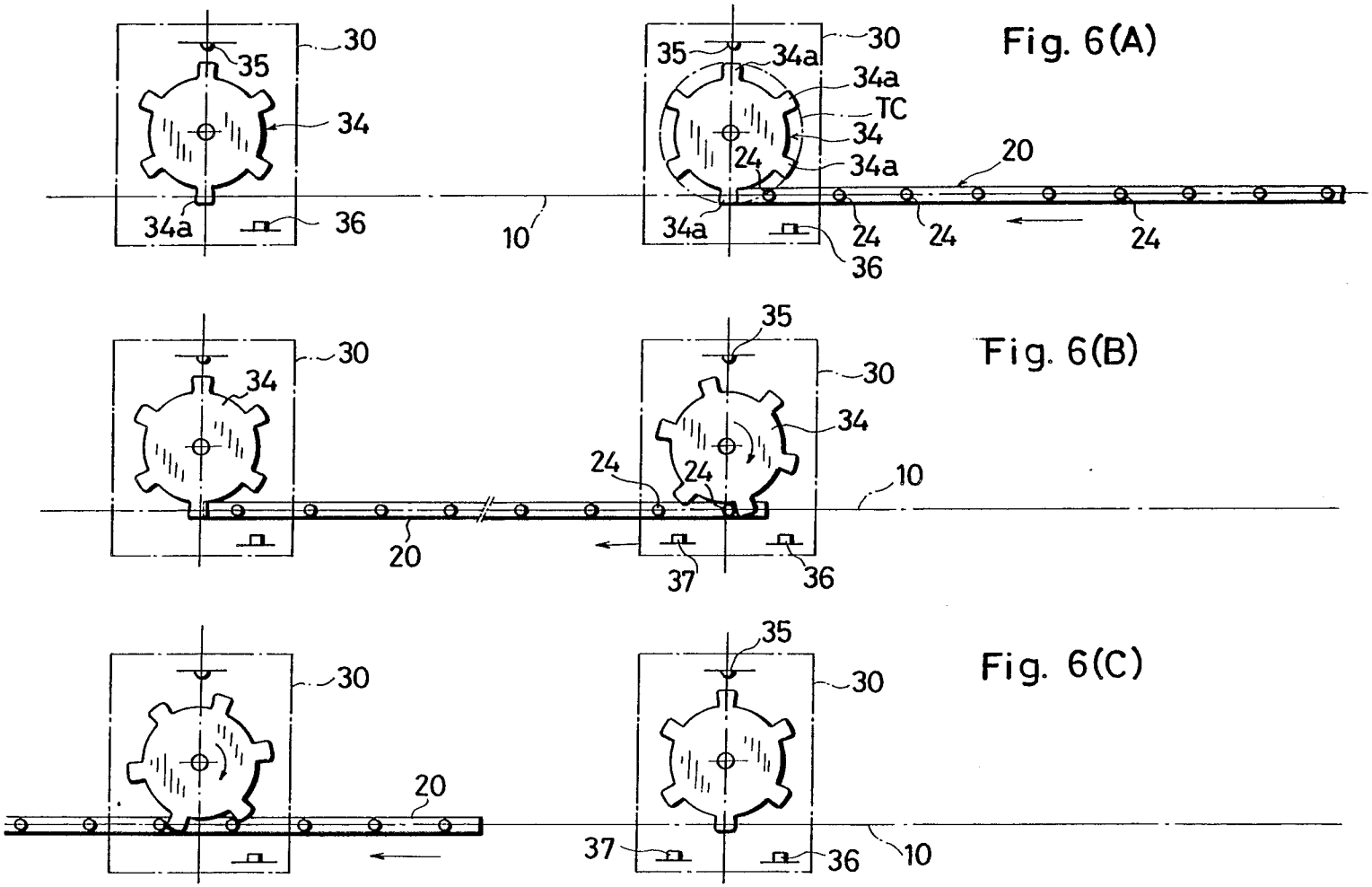
FIGS. 6(A), 6(B) and 6(C) are illustrative views showing relative positions of a carrier and a driving device of the rove bobbin transporting system of FIG. 1.

The predetermined number of driving devices 30 are disposed in a spaced relationship by a distance smaller than the overall length of the carrier 20 along the longitudinal direction of the transport rail 10. Each of the driving devices 30 includes an angle detecting sensor 35 for detecting that one of the teeth 34*a* of the rotary sprocket wheel 34 is in an angular position perpendicular to the transport rail 10 as seen in FIGS. 6(A) to 6(C), and an advancement detecting sensor 36 for detecting that a leading end of the carrier 20 which advances along the transport rail 10 reaches a position sufficiently near the rotary sprocket wheel 34. The angle detecting sensor 35 may be a contactless switch such as, for example, a photoelectric switch while the advancement detecting sensor 36 may be a like contactless switch or a conventional limit switch. The drive motor 33 of the driving device 30 is controlled, when it is to be stopped, such that, in response to an output signal of the angle detecting sensor 35, the rotary sprocket wheel 34 is stopped at a stand-by angular position in which one of the teeth 34*a* thereof extends perpendicularly to the transport rail 10 as seen in FIG. 6(A).

Operation of the rove bobbin transporting system having such a construction as described above will be described below.

It is to be noted that, since operation of the rove bobbin transporting system is similar whether rove bobbins B are hung on the bobbin hangers BH or not, the following description can be applied irrespective of presence or absence of rove bobbins B hung on the bobbin hangers BH.

At first, since the driving devices 30 are disposed in a spaced relationship by a distance smaller than the overall length of the carrier 20 when all of the driving devices 30 disposed along the transport rail 10 are in a stopped condition, the carrier 20 hung on the transport rail 10 opposes at least one of the driving devices 30 along the overall length thereof. Accordingly, the teeth 34*a* of the rotary sprocket wheel 34 involved in the opposing driving device 30 are held in engagement with the bobbin hanger mounting brackets 24 of the carrier 20. The other driving devices 30 are each stopped at a stand-by angular position in which one of the teeth 34*a* thereof extends perpendicularly to the transport rail 10.

When the carrier 20 is to be moved, the driver motor 33 of that one of the driving devices 30 in which the rotary sprocket wheel 34 is held in engagement with the bracket 24 is started. Consequently, the carrier 20 starts its traveling movement along the transport rail 10 since it receives a driving force from the drive motor 33 through engagement of the rotary sprocket wheel 34 with the brackets 24.

Since the connecting portions between the carrier frames 21 forming the carrier 20 can be bent both in the vertical and horizontal directions, the carrier 20 can travel smoothly even where the transport rail 10 is curved, in its route, in the vertical and/or horizontal directions with a radius of curvature greater than a predetermined radius of curvature as seen fron FIG. 2.

When the carrier 20 advances until the forward end thereof approaches the next driving device 30 as seen in FIG. 6(A), the rotary sprocket wheel 34 of the next driving device 20 remains in a stopped condition at its stand-by angular position in which one of the teeth 34*a* thereof extends perpendicularly to the transport rail 10. Thus, when the frontmost bracket 24 on the carrier 20 approaches a position in which it reaches the addendum circle TC of the rotary sprocket wheel 34, this is detected by the advancement detecting sensor 36. Then, if the drive motor 33 is started, the teeth 34*a* of the rotary sprocket wheel 34 can be brought into meshing engagement with the bracket 24 smoothly with certainty.

Once rotation of the rotary sprocket wheel 34 of the driving device 30 is started, the carrier 20 can be moved smoothly by the driving device of the driving device 30. Accordingly, the carrier 20 can continue its traveling movement irrespective of the condition of the driving device 30 from which the carrier 20 has received a driving force so far.

Here, the number of driving devices 30 will be minimized if the distance between two adjacent driving devices 30 is made substantially equal to the overall length of the carrier 20 so that, directly after one of two adjacent driving devices 30 is started, the rotary sprocket wheel 34 of the other driving device 20 may be disengaged from the bracket 24 as seen in FIGS. 6(B) and 6(C).

Since the rearmost bracket 24 of the carrier 20 is automatically disengaged from the rotary sprocket wheel 34 after the former has passed the position of the latter, the drive motor 33 of the driving device 30 may thereafter be stopped. Although the timing at which the drive motor 33 is to be stopped can be set by detection of the trailing end of the carrier 20 by the advancement detecting sensor 36, preferably another withdrawal detecting sensor 37 is provided for further improvement in reliability. While the advancement detecting sensor 36 is required to have a high degree of accuracy for detection of a starting timing of the drive motor 33, the withdrawal detecting sensor 37 may be provided because the stopping timing of the drive motor 33 need not be set with a high degree of accuracy. It is to be noted that, when the drive motor 33 is to be stopped, the angle detecting sensor 35 is rendered operative in response to a signal from the withdrawal detecting sensor 37 so that the rotary sprocket wheel 34 may be stopped at its stand-by angular position in which one of the teeth 34*a* thereof extends perpendicularly to the transport rail 10 in order to prepare for a subsequent operation.

By repetitions of such a sequence of operations as described above, the driving devices 30 successively apply a driving force to the carrier 20 so that the carrier 20 can continuously travel along the transport rail 20. Thus, for transportation of rove bobbins B, they are first mounted onto the bobbin BH of the carrier 20 at a predetermined position along the transport rail 10, and then the carrier 20 is moved to another predetermined position at which the rove bobbins B are subsequently removed from the bobbin hangers BH.

It is to be noted that it is a matter of course that the carrier 20 can be fed in the opposite direction if the direction of rotation of the rotary sprocket wheel 34 of each of the driving devices 30 is reversed. Also in this instance, the stand-by position of the sprocket wheel 34 may be such as described above. It is to be noted, however, that it is necessary to provide an advancement detecting sensor 36 at each of the opposite ends of each of the driving devices 30 in order to permit detection of approach of the carrier 20 from the opposite directions to the driving device 30. But if an advancement detecting sensor serves also as a withdrawal detecting sensor, provision of a separate withdrawal detecting sensor can be eliminated.

It is a matter of course that, as a mechanism for applying a driving force to the carrier 20 by means of the driving devices 30, engagement of the rotary sprocket wheel 34 with a separate engaging member provided on the carrier 20 may be meployed in place of the engagement of the rotary sprocket wheel 34 with the brackets 24. For example, either a large number of engaging pins arranged like a ladder may be provided vertically downwardly or a large number of rack teeth may be formed on side end faces of the carrier frames 21 forming the carrier 20 so that they may be engaged with the rotary sprocket wheel 34. Since the pitch of the teeth 34*a* of the rotary sprocket wheel 34 can be selected arbitrarily, it is possible to reduce the size of the rotary sprocket wheel 34.

It is to be noted that the connection between the drive motor 33 and the rotary sprocket wheel 34 can be provided, other than by the chain 33*c* and the chain sprocket wheels 33*b* and 33*b*, by any other motion transmitting mechanism such as, for example, a gearing assembly. Further, if a suitable slip mechanism or torque limiting mechanism is interposed between the drive motor 33 and the rotary sprocket wheel 34, inadvertent damage to the components including the rotary sprocket wheel 34 can be prevented even if the rotary sprocket wheel 34 is engaged and compulsorily rotated by the carrier 20 when the starting timing of the drive motor 33 is delayed. The slip mechanism or torque limiting mechanism may include 2 one-way clutches which are changed over depending upon the direction of rotation of the rotary sprocket wheel 34. With the arrangement, no slip will be yeilded in transmission of a driving force from the drive motor 33 to the rotary sprocket wheel 34 but a slip will be yielded with certainty in transmission of a driving force in the opposite direction. Accordingly, no loss will be caused in the driving force of the drive motor 33.

As apparent from the foregoing description, according to the present invention, a frictional power transmitting mechanism can be eliminated from a motion transmitting route from a drive motor to a carrier. Accordingly, it is an excellent effect that smooth operation can be assured readily for a long period of time.

What is claimed is:

1. In a rove bobbin transporting system which includes a transport rail and an elongated carrier mounted for movement along said transport rail and having a plurality of bobbin hangers provided in a juxtaposed relationship thereon for removably hanging rove bobbins thereon, wherein the improvement comprises a plurality of driving devices for moving said carrier which are disposed in a spaced relationship by a distance smaller than the overall length of said carrier along said transport rail and each include a drive motor and a rotary sprocket wheel having a plurality of teeth, and a plurality of engaging members for engaging with said teeth of said rotary sprocket wheel, respectively, said engaging members being disposed along the longitudinal dimension of said carrier and wherein said engaging members comprise brackets for mounting said bobbins to said carrier.

2. A rove bobbin transporting system according to claim 1, wherein said transport rail has a lower opening, and a support bolt extends through said lower opening of said transport rail and has a roller unit mounted at an upper portion thereof for traveling along said transport rail and a carrier frame connected to a lower portion thereof, said bobbin hangers on said carrier being provided in a juxtaposed relationship on said carrier frame.

3. A rove bobbin transporting system according to claim 1, wherein said engaging members for engaging with said rotary sprocket wheel are disposed on a carrier frame with a predetermined spacing therebetween.

4. A rove bobbin transporting system according to claim 3, wherein said rotary sprocket wheel of each of said driving devices is disposed for rotation in a horizontal plane, and the pitch of said teeth of said rotary sprocket wheel coincides with the pitch of bobbin mounting brackets which are provided in a juxtaposed relationship on said carrier frame.

5. A rove bobbin transporting system according to claim 1, wherein said carrier includes a plurality of carrier frames connected in series to each other, and a joint mechanism is provided between each two adjacent ones of said carrier frames such that the two adjacent carrier frames may be bent in a horizontal direction and also in a vertical direction relative to each other.

6. A rove bobbin transporting system according to claim 1, wherein each of said driving devices includes an advancement detecting sensor provided on the carrier incoming side thereof along said transport rail for detecting approach of said carrier, and said drive motor is started in response to said advancement detecting sensor.

7. A rove bobbin transporting system according to claim 1, wherein each of said driving devices includes a withdrawal detecting sensor provided on the carrier outgoing side thereof along said transport rail for detecting withdrawal of said carrier, and said drive motor is stopped in response to said withdrawal detecting sensor.

8. In a rove bobbin transporting system which includes a transport rail and an elongated carrier mounted for movement along said transport rail and having a plurality of bobbin hangers provided in a juxtaposed relationship thereon for removably hanging rove bobbins thereon, wherein the improvement comprises a plurality of driving devices for moving said carrier which are disposed in a spaced relationship by a distance smaller than the overall length of said carrier along said transport rail and each include a drive motor and a rotary sprocket wheel having a plurality of teeth, and a plurality of engaging members for engaging said teeth, respectively, of said rotary sprocket wheel, said engaging members being disposed along the longitudinal dimension of said carrier, wherein an angle detecting sensor for detecting a stopping angular position of said rotary sprocket wheel is provided adjacent a locus of rotation of said rotary sprocket wheel, and when said drive motor is stopped, said rotary sprocket wheel is positioned at a predetermined stand-by angular position relative to said transport rail.

* * * * *